US011098872B2

(12) United States Patent
Kosugi

(10) Patent No.: US 11,098,872 B2
(45) Date of Patent: Aug. 24, 2021

(54) VEHICLE LUMINAIRE AND VEHICLE LAMP

(71) Applicant: Toshiba Lighting & Technology Corporation, Yokosuka (JP)

(72) Inventor: Daisuke Kosugi, Ehime-ken (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 17/007,410

(22) Filed: Aug. 31, 2020

(65) Prior Publication Data

US 2021/0156538 A1 May 27, 2021

(30) Foreign Application Priority Data

Nov. 27, 2019 (JP) ..... JP2019-214180

(51) Int. Cl.

| | |
|---|---|
| ***F21S 45/10*** | (2018.01) |
| ***H05B 45/56*** | (2020.01) |
| ***F21S 45/47*** | (2018.01) |
| ***F21V 23/06*** | (2006.01) |
| ***H01C 7/02*** | (2006.01) |
| *F21Y 115/10* | (2016.01) |

(52) U.S. Cl.

CPC ..... *F21S 45/10* (2018.01); *F21S 45/47* (2018.01); *F21V 23/06* (2013.01); *H01C 7/02* (2013.01); *H05B 45/56* (2020.01); *F21Y 2115/10* (2016.08)

(58) Field of Classification Search

CPC ..... B60Q 1/04; B60Q 1/0416; B60Q 1/26; B60Q 1/2603; B60Q 11/00; B60Q 11/005; H05B 45/397; H05B 45/56; H05B 47/28; F21S 45/10; F21S 43/195; F21V 19/003; F21V 23/06; F21V 23/005

See application file for complete search history.

(56) References Cited

U.S. PATENT DOCUMENTS

| | | | | |
|---|---|---|---|---|
| 2013/0193851 | A1* | 8/2013 | Alon | H05B 45/46 315/121 |
| 2016/0262231 | A1* | 9/2016 | Iellina | H05B 45/50 |
| 2017/0027033 | A1* | 1/2017 | Chobot | H05B 45/397 |
| 2017/0109997 | A1* | 4/2017 | Brooks | G01R 31/006 |
| 2019/0259917 | A1 | 8/2019 | Yamanaka et al. | |

FOREIGN PATENT DOCUMENTS

| | | | |
|---|---|---|---|
| EP | 3534061 | A1 | 9/2019 |
| JP | 2000-278859 | A | 10/2000 |
| JP | 2015-022879 | | 2/2015 |

* cited by examiner

*Primary Examiner* — Thai Pham

(74) *Attorney, Agent, or Firm* — Banner & Witcoff, Ltd.

(57) ABSTRACT

A vehicle luminaire according to an embodiment includes: a socket; and a light-emitting module which is provided at one end side of the socket. The light-emitting module includes: at least one light-emitting element; a first transistor of which a source is electrically connected to a cathode of the light-emitting element; a negative characteristic thermistor which is electrically connected to a gate of the first transistor; a positive characteristic thermistor which is electrically connected to the gate of the first transistor or a drain of the first transistor; and a second transistor of which a collector is electrically connected to the gate of the first transistor, a base is electrically connected to the drain of the first transistor, and an emitter is electrically connected to an output terminal.

20 Claims, 12 Drawing Sheets

VEHICLE LUMINAIRE AND VEHICLE LAMP

CROSS-REFERENCE TO RELATED APPLICATIONS

This application is based upon and claims the benefit of priority from Japanese Patent Application No. 2019-214180, filed on Nov. 27, 2019; the entire contents of which are incorporated herein by reference.

FIELD

Embodiments described herein relate to a vehicle luminaire and a vehicle lamp.

BACKGROUND

From the viewpoint of energy saving and long life, a vehicle luminaire having a light-emitting diode has been widely used instead of a vehicle luminaire having a filament.

When lighting the vehicle luminaire, a voltage is applied to the vehicle luminaire (the light-emitting diode). When a voltage is applied to the light-emitting diode, a current flows through the light-emitting diode so that heat is generated and the temperature of the light-emitting diode rises. Further, in the case of the vehicle luminaire for an automobile, a high voltage may be applied to the light-emitting diode due to a variation in input voltage or an environmental temperature may become high in some cases. In this case, when the temperature of the light-emitting diode is too high, there is a risk that the light-emitting diode may be broken or the life of the light-emitting diode may be shortened.

Here, when the temperature of the light-emitting diode is too high due to a parallel connection of a resistor and a circuit in which a resistor and a positive characteristic thermistor are connected in series to each other, there is proposed a technique in which a current flows only to the resistor connected in parallel by interrupting a current flowing to the circuit by the positive characteristic thermistor. With such a configuration, the light-emitting diode can be protected. However, there was a room for improvement in suppressing a variation in total luminous flux with a change in temperature.

Here, it has been desired to develop a technique capable of protecting a light-emitting diode and suppressing a variation in total luminous flux with a change in temperature.

DETAILED DESCRIPTION

Figure 1:
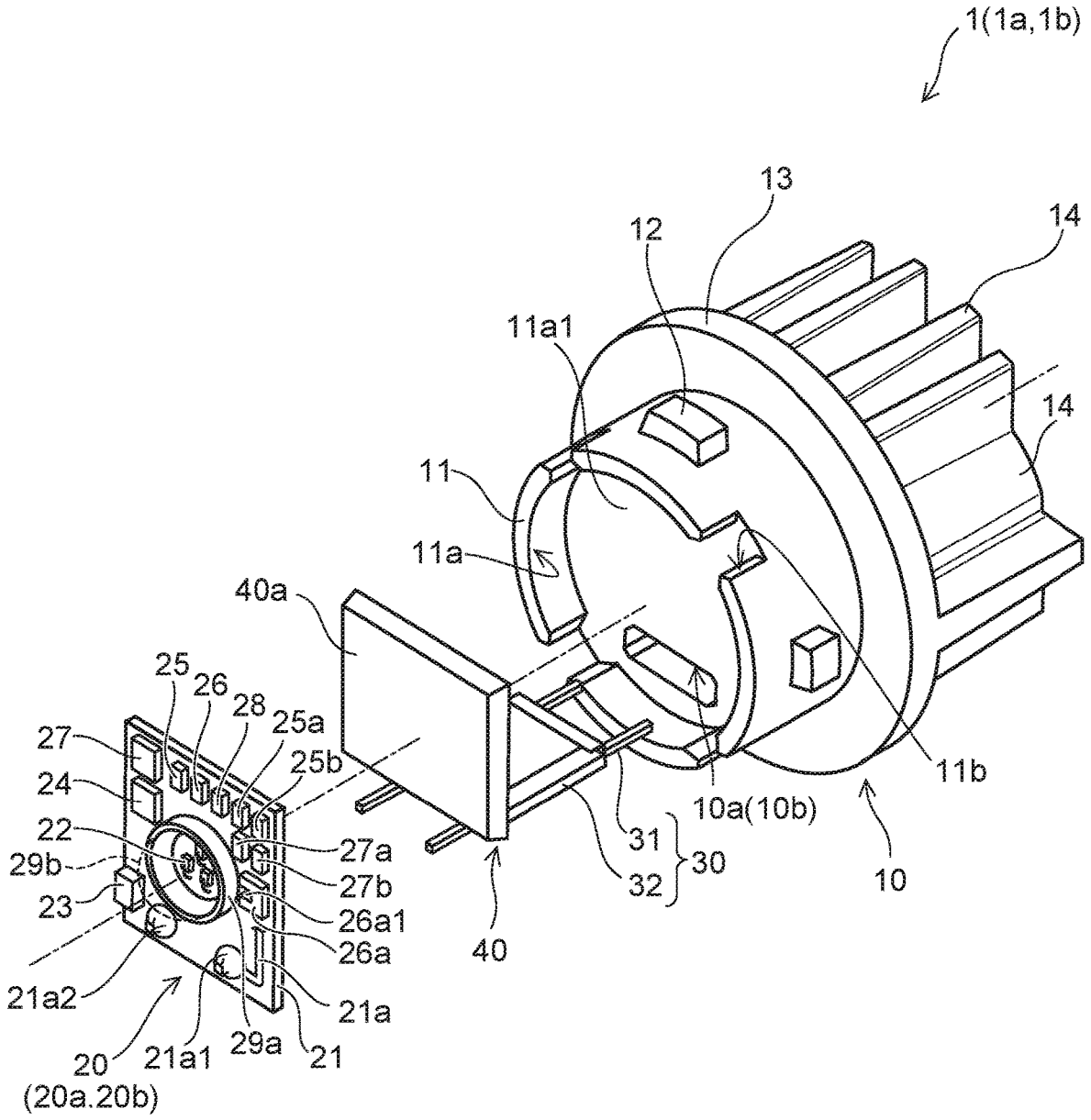
FIG. 1 is a schematic exploded view of a vehicle luminaire according to an embodiment.

A vehicle luminaire according to an embodiment includes: a socket; and a light-emitting module which is provided at one end side of the socket. The light-emitting module includes: at least one light-emitting element; a first transistor of which a source is electrically connected to a cathode of the light-emitting element; a negative characteristic thermistor which is electrically connected to a gate of the first transistor; a positive characteristic thermistor which is electrically connected to the gate of the first transistor or a drain of the first transistor; and a second transistor of which a collector is electrically connected to the gate of the first transistor, a base is electrically connected to the drain of the first transistor, and an emitter is electrically connected to an output terminal.

Hereinafter, an embodiment will be illustrated with reference to the drawings. In the drawings, the same components are indicated by the same reference numerals and detailed description thereof will be appropriately omitted.

(Vehicle Luminaire)

A vehicle luminaire 1 according to an embodiment can be provided in, for example, automobiles and rail cars. Examples of the vehicle luminaire 1 provided in automobiles include, for example, a front combination light (for example, an appropriate combination of a daytime running lamp (DRL), a position lamp, a turn signal lamp, and the like), a rear combination light (for example, an appropriate combination of a stop lamp, a tail lamp, a turn signal lamp, a back lamp, a fog lamp, and the like), and the like. However, the application of the vehicle luminaire 1 is not limited to these.

FIG. 1 is a schematic exploded view of the vehicle luminaire 1 according to the embodiment.

Figure 2:
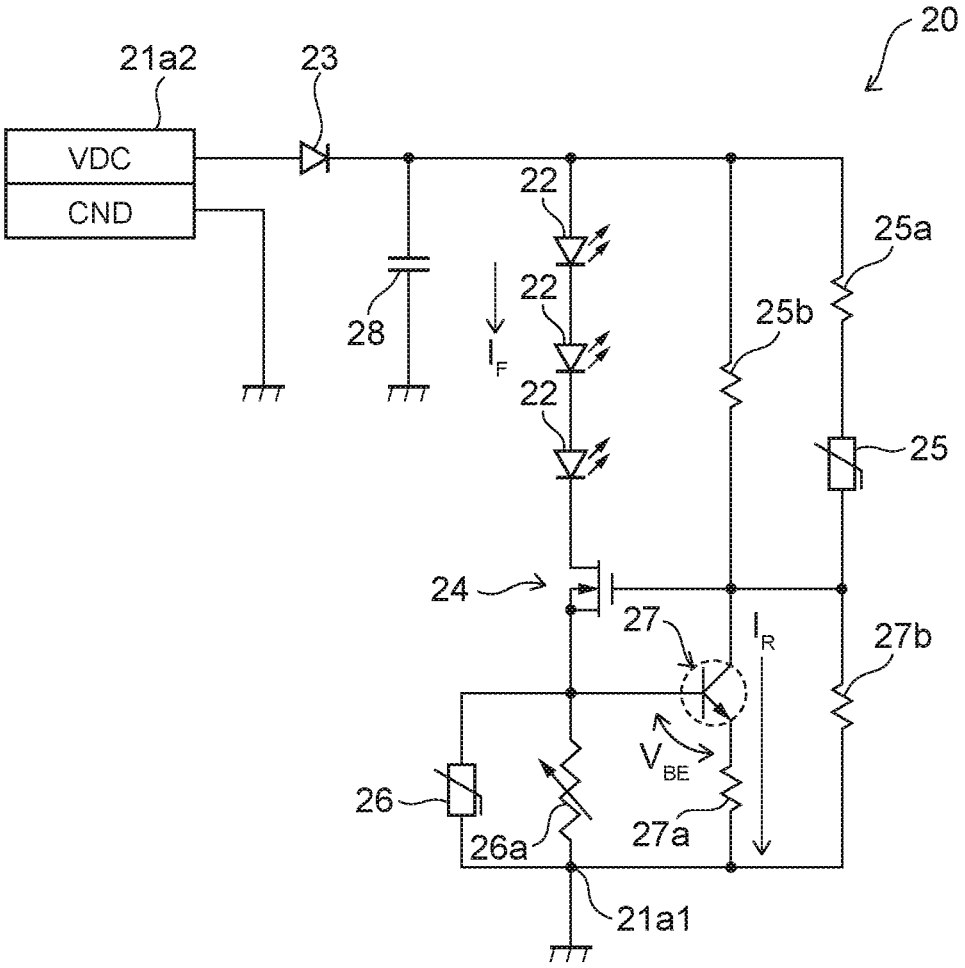
FIG. 2 is a circuit diagram of a light-emitting module.

FIG. 2 is a circuit diagram of a light-emitting module 20.

As shown in FIG. 1, the vehicle luminaire 1 can be provided with a socket 10, a light-emitting module 20, a power-supply unit 30, and a heat transfer portion 40.

The socket 10 can include a mounting portion 11, a bayonet 12, a flange 13, and a radiating fin 14.

The mounting portion 11 can be provided on a surface opposite to the installation side of the radiating fin 14 in the flange 13. The outer shape of the mounting portion 11 can be a pillar shape. The outer shape of the mounting portion 11 is, for example, a columnar shape. The mounting portion 11 can include a concave portion 11*a* opening to an end opposite to the flange 13.

At least one slit 11*b* can be provided in the mounting portion 11. A corner portion of a substrate 21 can be provided in the slit 11*b*. The dimension (width) of the slit 11*b* in the circumferential direction of the mounting portion 11 can be slightly larger than the dimension of the corner portion of the substrate 21. With such a configuration, the substrate 21 can be positioned by inserting the corner portion of the substrate 21 into the slit 11*b*.

Further, the planar shape of the substrate 21 can be enlarged when the slit 11*b* is provided. Therefore, the number of elements mounted on the substrate 21 can be increased. Alternatively, since the outer dimension of the mounting portion 11 can be decreased, a decrease in size of the mounting portion 11 and further a decrease in size of the vehicle luminaire 1 can be realized.

The bayonet 12 can be provided on the outer surface of the mounting portion 11. For example, the bayonet 12 protrudes toward the outside of the vehicle luminaire 1. The bayonet 12 can face the flange 13. A plurality of the bayonets 12 can be provided. The bayonet 12 can be used when mounting the vehicle luminaire 1 to a housing 101 of a vehicle lamp 100. The bayonet 12 can be used for a twist lock.

The flange 13 can have a plate shape. For example, the flange 13 can have a disk shape. The outer surface of the flange 13 can be located on the outside of the vehicle luminaire 1 in relation to the outer surface of the bayonet 12.

The radiating fin 14 can be provided on the side opposite to the mounting portion 11 in the flange 13. At least one radiating fin 14 can be provided. For example, the socket illustrated in FIG. 1 is provided with a plurality of the radiating fins 14. The plurality of radiating fins 14 can be provided side by side in a predetermined direction. The radiating fin 14 can have a plate shape.

Further, the socket 10 can be provided with a hole 10*a* and a hole 10*b*. One end of the hole 10*a* opens to a bottom surface 11*a*1 of the concave portion 11*a*. A holder 32 can be provided inside the hole 10*a*. One end of the hole 10*b* is connected to the other end of the hole 10*a*. The other end of the hole 10*b* opens to an end on the side of the radiating fin 14 in the socket 10. End portions of a plurality of power-supply terminals 31 are exposed inside the hole 10*b*. A connector 105 having a seal member 105*a* is inserted into the hole 10*b* and the connector 105 is fitted to the ends of the plurality of power-supply terminals 31.

The socket 10 can have a function of holding the light-emitting module 20 and the power-supply unit 30 and a function of transferring heat generated in the light-emitting module 20 to the outside. Therefore, it is preferable that the socket 10 be formed of a material having a high thermal conductivity such as metal.

Further, in recent years, it is preferable that the socket can efficiently radiate heat generated in the light-emitting module 20 and have light weight. Therefore, it is more preferable that the socket 10 be formed of a high thermal conductive resin. The high thermal conductive resin includes, for example, a resin and a filler using an inorganic material. For example, the high thermal conductive resin can be obtained by mixing a filler using carbon or aluminum oxide with a resin such as polyethylene terephthalate (PET) or nylon.

According to the socket 10 which is integrally formed with the mounting portion 11, the bayonet 12, the flange 13, and the radiating fin 14 by including a high thermal conductive resin, heat generated in the light-emitting module 20 can be efficiently radiated. Further, the socket 10 can have a light weight. In this case, the mounting portion 11, the bayonet 12, the flange 13, and the radiating fin 14 can be integrally molded by using an injection-molding method or the like. Further, the socket 10 and the power-supply unit 30 can be integrally molded by using an insert-molding method or the like.

The power-supply unit 30 can include the plurality of power-supply terminals 31 and the holder 32.

The plurality of power-supply terminals 31 can be pin-shaped bodies. The ends on the side of the light-emitting module 20 in the plurality of power-supply terminals 31 can be soldered to an output terminal 21*a*1 and an input terminal 21*a*2 of a wiring pattern 21*a*. The ends on the side of the radiating fin 14 in the plurality of power-supply terminals 31 are exposed inside the hole 10*b*. The power-supply terminal 31 can be formed of, for example, metal such as copper alloy. Additionally, the number, shape, arrangement, material, and the like of the power-supply terminals 31 are not limited to those illustrated above, but can be changed as appropriate.

As described above, it is preferable that the socket 10 be formed of a material having high thermal conductivity. Incidentally, a material having high thermal conductivity may be conductive. For example, a high thermal conductive resin or the like using carbon is conductive. Therefore, the holder 32 can be provided to insulate the power-supply terminal 31 and the conductive socket 10. Further, the holder 32 can also have a function of holding the plurality of power-supply terminals 31. Additionally, when the socket 10 is formed of a high thermal conductive resin having an insulation property (for example, a high thermal conductive resin or the like including aluminum oxide), the holder 32 can be omitted. In this case, the socket 10 can hold the plurality of power-supply terminals 31. The holder 32 can be formed of a material having an insulation property. For example, the holder 32 can be press-inserted into the hole 10*a* provided in the socket 10 or can be bonded to the inner wall of the hole 10*a*.

The heat transfer portion 40 can be provided between the socket 10 and the light-emitting module 20 (the substrate 21). The heat transfer portion 40 can be provided to easily transfer heat generated in the light-emitting module 20 to the socket 10. The heat transfer portion 40 can include, for example, metal. The metal can be, for example, aluminum, aluminum alloy, copper, copper alloy, or the like. The heat transfer portion 40 can be bonded to the bottom surface 11*a*1 of the concave portion 11*a*. In this case, it is preferable that the adhesive have high thermal conductivity. For example, the adhesive can be an adhesive mixed with a filler using an inorganic material. Further, the heat transfer portion 40 can also be attached to the bottom surface 11*a*1 of the concave portion 11*a* through a layer containing thermal conductive grease (thermal grease). The thermal conductive grease can be, for example, a mixture of modified silicone and a filler using an inorganic material. Further, the heat transfer portion can be buried in the bottom surface 11*a*1 of the concave portion 11*a* by using an insert-molding method or the like.

Additionally, when the heat generated in the light-emitting module 20 is small, the heat transfer portion 40 can be omitted. When the heat transfer portion 40 is omitted, for example, the light-emitting module 20 can be bonded to the bottom surface 11*a*1 of the concave portion 11*a*.

The light-emitting module 20 can be provided on one end side of the socket 10.

The light-emitting module 20 can include the substrate 21, a light-emitting element 22, a diode 23, a first transistor 24, a negative characteristic thermistor 25, a positive characteristic thermistor 26, a second transistor 27, a frame portion 29*a*, and a sealing portion 29*b*. Further, the light-emitting module 20 can further include a resistor 25*a*, a resistor 25*b*, a resistor 26*a* (corresponding to an example of a second resistor), a resistor 27*a*, a resistor 27*b*, and a capacitor 28 to be described later. These elements can be electrically connected to the wiring pattern 21*a* provided in the substrate 21.

The substrate 21 can be bonded to, for example, a surface 40*a* on the side opposite to the bottom surface 11*a*1 of the concave portion 11*a* in the heat transfer portion 40. The adhesive that bonds the substrate 21 to the heat transfer portion 40 can be the same as the adhesive that bonds the heat transfer portion 40 to the bottom surface 11*a*1 of the concave portion 11*a*. The substrate 21 can be formed of, for example, an inorganic material such as ceramics (for example, aluminum oxide or aluminum nitride) or an organic material such as paper phenol or glass epoxy. Further, the substrate 21 can be a metal plate of which a surface is coated with an insulating material. When the light-emitting element 22 generates a large amount of heat, it is preferable that the substrate 21 be formed of a material having high thermal conductivity from the viewpoint of thermal radiation. Examples of the material having high thermal conductivity include ceramics such as aluminum oxide and aluminum nitride, a high thermal conductive resin, and a metal plate whose surface is coated with an insulating material. Further, the substrate 21 may have a single-layer structure or a multi-layer structure.

Further, a surface of the substrate 21 can be provided with the wiring pattern 21*a*. The wiring pattern 21*a* can be formed of, for example, a material containing silver as a main component or a material containing copper as a main component.

The light-emitting element 22 can be provided on the side opposite to the heat transfer portion 40 in the substrate 21. At least one light-emitting element 22 can be provided. In the case of the vehicle luminaire 1 illustrated in FIGS. 1 and 2, a plurality of the light-emitting elements 22 are provided. Additionally, when the plurality of light-emitting elements 22 are provided, the plurality of light-emitting elements 22 can be connected in series.

The light-emitting element 22 can be, for example, a light-emitting diode, an organic light-emitting diode, a laser diode, or the like.

The light-emitting element 22 can be, for example, a chip-shaped light-emitting element, a surface mount type light-emitting element, a shell type light-emitting element having a lead wire, or the like. However, the chip-shaped light-emitting element is preferable in consideration of a decrease in size of the light-emitting module 20 and further a decrease in size of the vehicle luminaire 1. The chip-shaped light-emitting element 22 can be mounted by chip on board (COB). The chip-shaped light-emitting element 22 can be, for example, a vertical light-emitting element, an upper light-emitting element, a flip chip light-emitting element, or the like. The light-emitting element 22 illustrated in FIG. 1 is the vertical light-emitting element.

As shown in FIG. 2, the diode 23 can be electrically connected across the light-emitting element 22 and the input terminal 21*a*2. The diode 23 can be provided to suppress a reverse voltage from being applied to the light-emitting element 22 and to suppress pulse noise from the reverse direction from being applied to the light-emitting element 22. The diode 23 can be, for example, a surface mount type diode or a diode having a lead wire. The diode 23 illustrated in FIG. 1 is a surface mount type diode.

The first transistor 24 can be connected in series to the light-emitting element 22. The first transistor 24 can control the value of the current flowing through the light-emitting element 22 and further the total luminous flux of the light emitted from the light-emitting element 22. The first transistor 24 can be a field effect transistor (FET). The gate of the first transistor 24 can be electrically connected to the negative characteristic thermistor 25. The source of the first transistor 24 can be electrically connected to the cathode of the light-emitting element 22. The drain of the first transistor 24 can be electrically connected to the positive characteristic thermistor 26.

The resistance value of the negative characteristic thermistor 25 gradually decreases when the temperature rises.

As shown in FIG. 1, it is preferable that the negative characteristic thermistor 25 be provided adjacent to the positive characteristic thermistor 26. With such a configuration, since a difference between the temperature of the negative characteristic thermistor 25 and the temperature of the positive characteristic thermistor 26 can be minimized, an effect shown in FIGS. 5A to 5D to be described later can be effectively obtained.

The negative characteristic thermistor 25 can be connected in series to the resistor 25*a*. The resistor 25*a* can be provided to suppress the resistance value of the portion where the negative characteristic thermistor 25 is provided from decreasing too much when the temperature of the negative characteristic thermistor 25 rises. That is, the resistor can be provided to suppress the negative characteristic thermistor 25 from being broken due to an overcurrent flowing through the negative characteristic thermistor 25 when the resistance value of the negative characteristic thermistor 25 becomes small.

Additionally, the resistor 25*b* connected in parallel to the negative characteristic thermistor 25 can be provided to adjust the change rate of the current $I_R$ flowing through the resistor 27*a* with respect to the temperature.

When the temperature of the positive characteristic thermistor 26 exceeds the Curie point, the resistance value rapidly increases. The positive characteristic thermistor 26 can be connected in series to the light-emitting element 22 via the first transistor 24. The light-emitting element 22 and the positive characteristic thermistor 26 are thermally connected to each other through the substrate 21 or the wiring pattern 21*a*. Therefore, when the temperature of the light-emitting element 22 rises, the temperature of the positive characteristic thermistor 26 rises and the resistance value of the positive characteristic thermistor 26 rises. Since the value of the current flowing through the light-emitting element 22 decreases when the resistance value of the positive characteristic thermistor 26 increases, an increase in the temperature of the light-emitting element 22 can be suppressed. Therefore, it is possible to suppress the light-emitting element 22 from being broken or to suppress the life of the light-emitting element 22 from being shortened.

Additionally, the resistor 26*a* connected in parallel to the positive characteristic thermistor 26 can be provided to reduce an influence due to a variation in the resistance value of the positive characteristic thermistor 26.

The operations and effects of the negative characteristic thermistor 25, the positive characteristic thermistor 26, and the resistor 26*a* will be described in detail later (for example, see FIGS. 4A to 7D).

The second transistor 27 can be, for example, a bipolar transistor. The collector of the second transistor 27 can be electrically connected to the gate of the first transistor 24 and the negative characteristic thermistor 25. The base of the second transistor 27 can be electrically connected to the drain of the first transistor 24 and the positive characteristic thermistor 26. The emitter of the second transistor 27 can be electrically connected to the output terminal 21*a*1 via the resistor 27*a*.

For example, the resistor 27*a* can be provided to increase the sum of a voltage $V_{BE}$ across the base and the emitter of the second transistor 27 and a voltage $V_{27a}$ across both ends of the resistor 27*a*.

Additionally, the resistor 27*b* can be provided to ensure the voltage for operating the gate of the first transistor 24. Further, the resistance value of the resistor 27*b* is set to be higher than a threshold voltage at which the gate is operated by the voltage division of the combined resistance of the resistor 25*a*, the resistor 25*b*, and the negative characteristic thermistor 25.

Further, the capacitor 28 can be provided, for example, as a measure against noise and smoothing the voltage.

As shown in FIG. 1, the frame portion 29*a* can be bonded to the substrate 21. The frame portion 29*a* can have a frame shape. At least one light-emitting element 22 can be provided in a region surrounded by the frame portion 29*a*. For example, the frame portion 29*a* can surround the plurality of light-emitting elements 22.

Additionally, a case in which the frame portion 29*a* is molded by an injection-molding method or the like and the molded frame portion 29*a* is bonded to the substrate 21 has been illustrated, but the invention is not limited thereto. The frame portion 29*a* can also be formed, for example, by applying a melted resin in a frame shape on the substrate 21 using a dispenser or the like and curing the resin.

Further, the frame portion 29*a* can have a function of a reflector that reflects the light emitted from the light-emitting element 22.

Additionally, the frame portion 29*a* can be omitted. When the frame portion 29*a* is omitted, a dome-shaped sealing portion 29*b* is formed on the substrate 21. However, the formation range of the sealing portion 29*b* can be defined when the frame portion 29*a* is provided. Therefore, since an increase in the planar dimension of the sealing portion 29*b* can be suppressed, a decrease in size of the substrate 21 and further a decrease in size of the vehicle luminaire 1 can be realized.

The sealing portion 29*b* can be provided inside the frame portion 29*a*. The sealing portion 29*b* can cover a region surrounded by the frame portion 29*a*. The sealing portion 29*b* can cover the light-emitting element 22. The sealing portion 29*b* can be formed of a light transmitting material. The sealing portion 29*b* can be formed by filling, for example, a resin into the region surrounded by the frame portion 29*a*. The resin can be filled by using, for example, a dispenser or the like. The resin to be filled can be, for example, a silicone resin or the like. Further, the sealing portion 29*b* can include a phosphor. The phosphor can be, for example, a YAG-based phosphor (yttrium-aluminum-garnet-based phosphor). However, the type of phosphor can be appropriately changed so as to obtain a predetermined emission color according to the application of the vehicle luminaire 1.

Additionally, when using a surface mount type light-emitting element or a shell type light-emitting element having a lead wire, the frame portion 29*a* and the sealing portion 29*b* can be omitted. However, as described above, it is preferable that the light-emitting element 22 is a chip-shaped light-emitting element and the frame portion 29*a* and the sealing portion 29*b* are provided when a decrease in size of the substrate 21 is considered.

Next, the operations and effects of the negative characteristic thermistor 25, the positive characteristic thermistor 26, and the resistor 26*a* will be further described.

First, the operation of a light-emitting module 120 according to a comparative example will be described.

Figure 3:
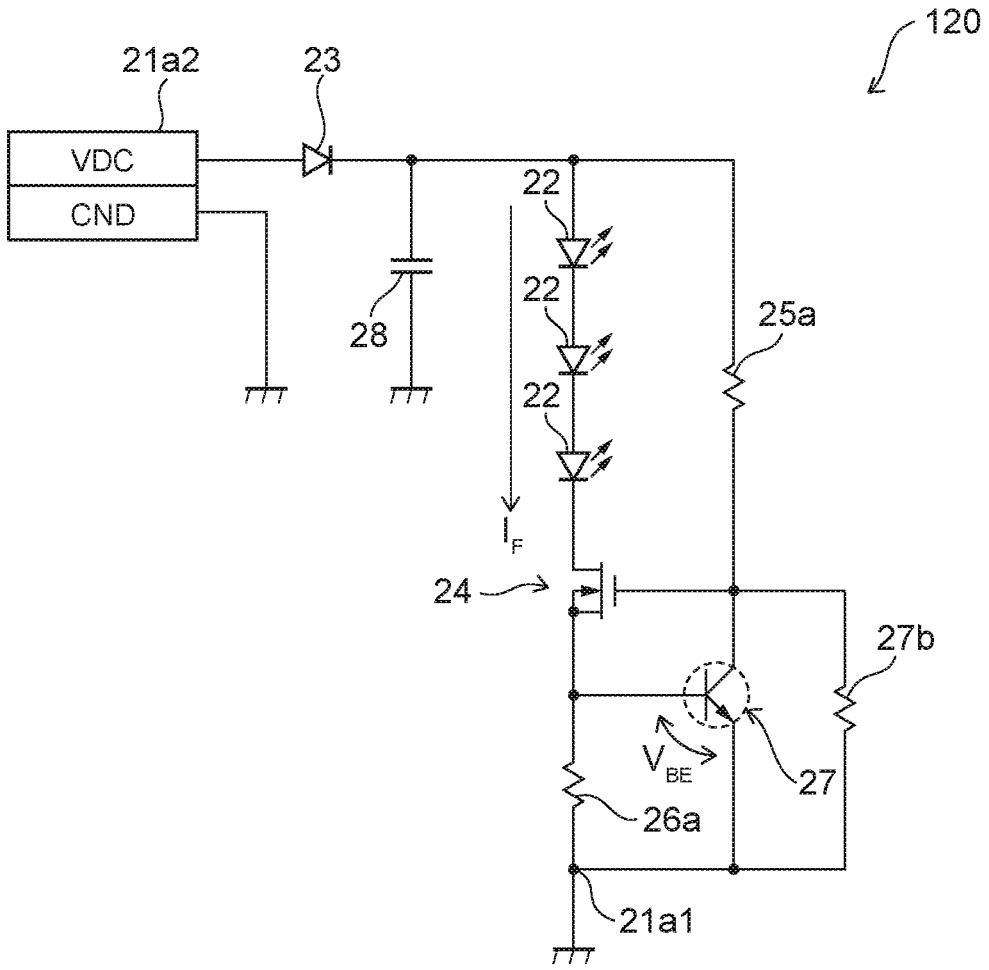
FIG. 3 is a circuit diagram of a light-emitting module according to a comparative example.

FIG. 3 is a circuit diagram of the light-emitting module 120 according to the comparative example.

As shown in FIG. 3, the light-emitting module 120 according to the comparative example is not provided with the negative characteristic thermistor 25 and the positive characteristic thermistor 26.

When a current $I_F$ flows through the light-emitting element 22, light is emitted from the light-emitting element 22, but heat is also generated. When the generated heat is transferred to the second transistor 27 through the substrate 21, the temperature of the second transistor 27 rises. When the temperature of the second transistor 27 rises, the voltage $V_{BE}$ across the base and the emitter decreases. When the voltage $V_{BE}$ decreases, the current $I_F$ flowing through the light-emitting element 22 decreases.

For example, when the temperature of the second transistor 27 is 25° C., the voltage $V_{BE}$ is about 0.63 V. When the temperature of the second transistor 27 is 100° C., the voltage $V_{BE}$ is about 0.46 V. When the resistance value of the resistor 26*a* is 2 n, the current $I_F$ when the temperature of the second transistor 27 is 25° C. is about 0.315 A. The current $I_F$ when the temperature of the second transistor 27 is 100° C. is about 0.23 A.

Figure 4A:
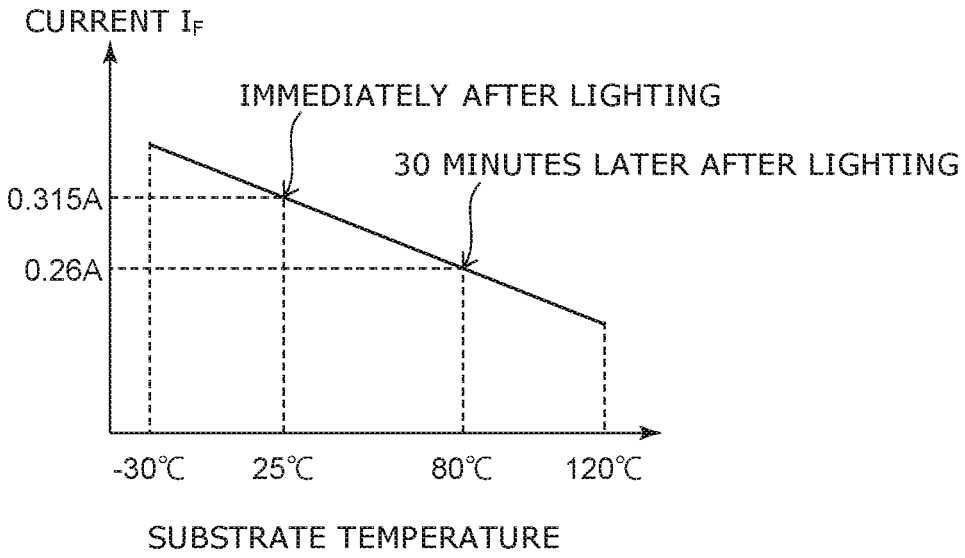
FIG. 4A is a graph showing a relationship between a current and a substrate temperature in the light-emitting module and FIG. 4B is a graph showing a desired relationship between a current and a substrate temperature in the vehicle luminaire.

FIG. 4A is a graph showing a relationship between the current $I_F$ and the substrate temperature in the light-emitting module 120.

Figure 4B:
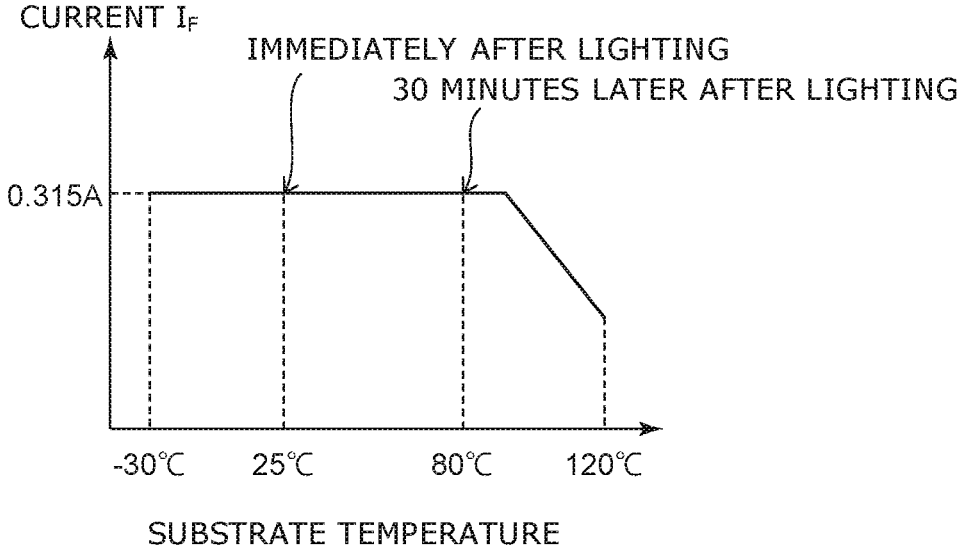

FIG. 4B is a graph showing a desired relationship between the current $I_F$ and the substrate temperature in the vehicle luminaire 1.

The temperature of the substrate 21 gradually rises due to the heat generated when lighting the light-emitting element 22. Since the temperature of the second transistor 27 gradually rises when the temperature of the substrate 21 gradually rises, the current $I_F$ flowing through the light-emitting element 22 gradually decreases as shown in FIG. 4A. Therefore, the total luminous flux of the light emitted from the vehicle luminaire may decrease over time and the driver may feel uncomfortable.

For example, as shown in FIG. 4B, it is preferable that a decrease in the total luminous flux of the light emitted from the vehicle luminaire be reduced even after a predetermined time elapses. Additionally, when the temperature of the light-emitting element 22 is too high, there is a risk that the light-emitting element 22 may be broken or the life may be shortened. Therefore, when the temperature of the substrate 21 is too high (the temperature of the light-emitting element 22 is too high), it is preferable to suppress the temperature of the light-emitting element 22 from increasing too high by reducing the current $I_F$ flowing through the light-emitting element 22 as shown in FIG. 4B.

Here, in the light-emitting module 20 according to the embodiment, a decrease in the total luminous flux is reduced by providing the negative characteristic thermistor 25. Further, the temperature of the light-emitting element 22 is suppressed from increasing too high by providing the positive characteristic thermistor 26.

FIGS. 5A to 5D are graphs showing the operation of the negative characteristic thermistor 25.

Figure 5A:
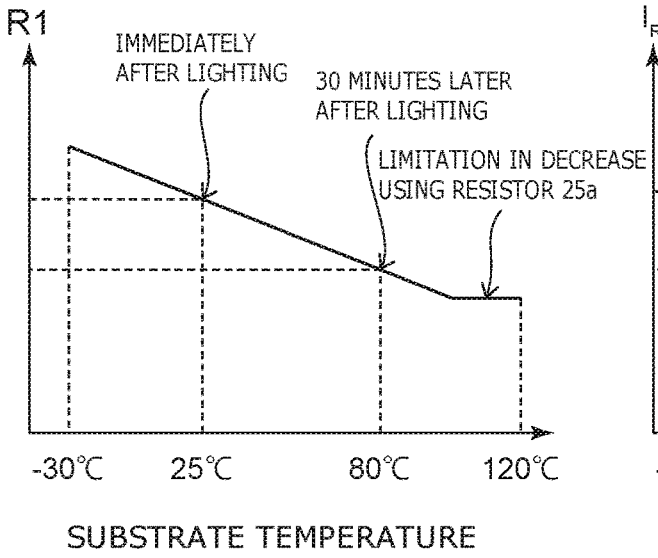
FIGS. 5A to 5D are graphs showing the operation of a negative characteristic thermistor.

Since the temperature of the negative characteristic thermistor 25 also rises when the temperature of the substrate 21 rises, the resistance value of the negative characteristic thermistor 25 corresponding to the negative characteristic thermistor gradually decreases in accordance with an increase in the temperature. Therefore, as shown in FIG. 5A, the combined resistance value R1 of the negative characteristic thermistor 25 and the resistor 25*a* gradually decreases as the lighting time elapses. Additionally, since the resistance value of the resistor 25*a* is substantially constant even when the temperature rises, a decrease in the combined resistance value R1 can be limited.

Figure 5B:
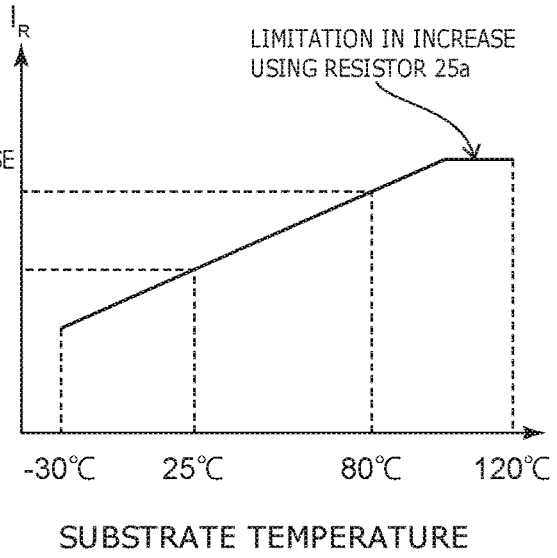

Further, as shown in FIG. 5B, the current $I_R$ flowing through the resistor 27*a* increases in accordance with a decrease in the combined resistance value R1. Additionally, since a decrease in the combined resistance value R1 is limited as described above, an increase in the current $I_R$ can also be limited.

Figure 5C:
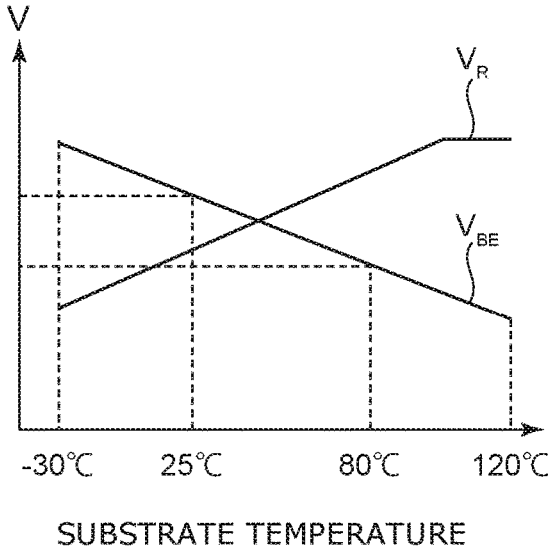

As shown in FIG. 5C, when the temperature of the second transistor 27 rises, the voltage $V_{BE}$ across the base and the emitter decreases. When the current $I_R$ flowing through the resistor 27*a* increases, the voltage $V_R$ across both ends of the resistor 27*b* increases. As described above, since an increase in the current $I_R$ is limited, an increase in the voltage $V_R$ can also be limited.

Therefore, since a mutual change can be canceled out by adding the voltage $V_{BE}$ and the voltage $V_R$ to each other, a change can be little even when the temperature of the substrate 21 rises.

Figure 5D:
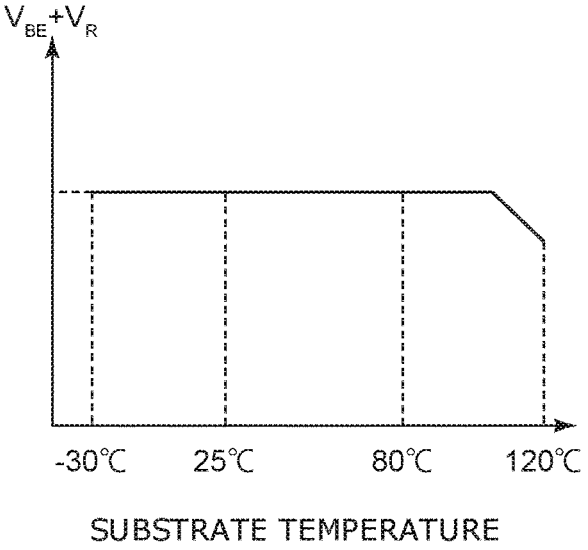

As shown in FIG. 5D, when the sum of the voltage $V_{BE}$ and the voltage $V_R$ is small, a change in the current $I_F$ flowing through the light-emitting element 22 can be reduced.

Therefore, when the negative characteristic thermistor is provided, the total luminous flux can be suppressed from decreasing with the elapse of the lighting time.

FIGS. 6A to 6D are graphs showing the operation of the positive characteristic thermistor 26.

Figure 6A:
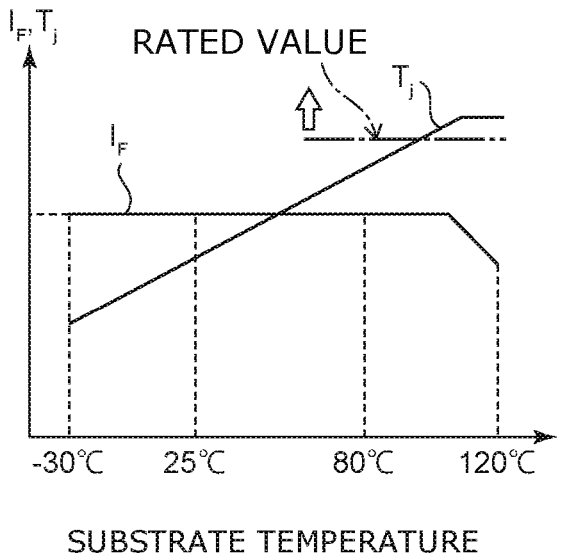
FIGS. 6A to 6D are graphs showing the operation of a positive characteristic thermistor.

When performing control using the negative characteristic thermistor 25, the junction temperature $T_j$ of the light-emitting element 22 may exceed the rated value as shown in FIG. 6A. When the junction temperature $T_j$ exceeds the rated value, there is a risk that the light-emitting element 22 may be broken or the life may be shortened.

Figure 6B:
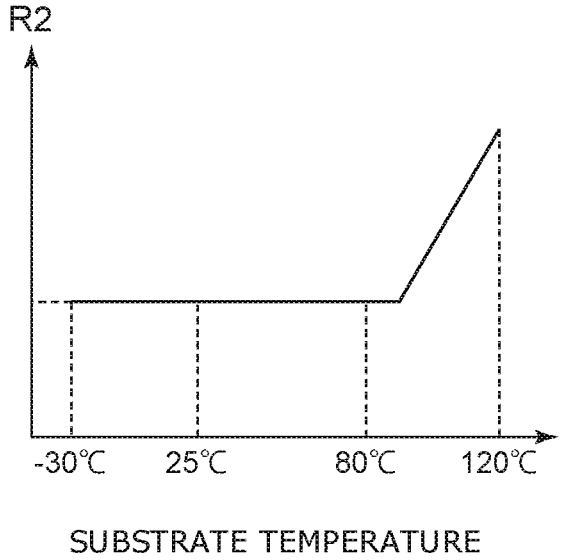

When the temperature of the substrate 21 becomes high so that the temperature of the positive characteristic thermistor 26 exceeds the Curie point, the resistance value rapidly increases. In this case, as shown in FIG. 6B, the combined resistance value R2 of the positive characteristic thermistor 26 and the resistor 26*a* also rapidly increases when the temperature exceeds the Curie point.

Figure 6C:
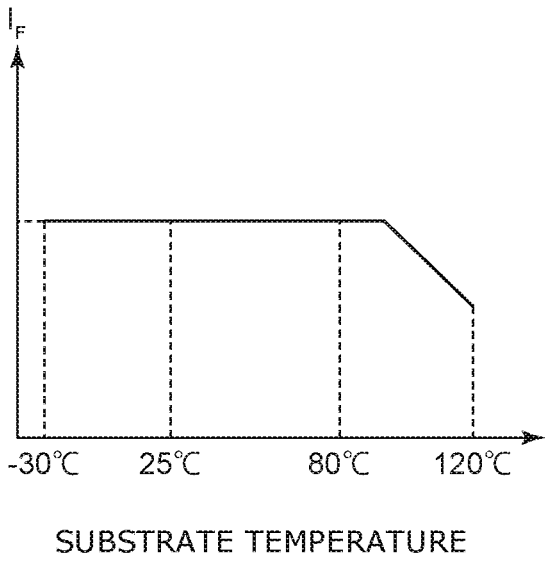
Figure 6D:
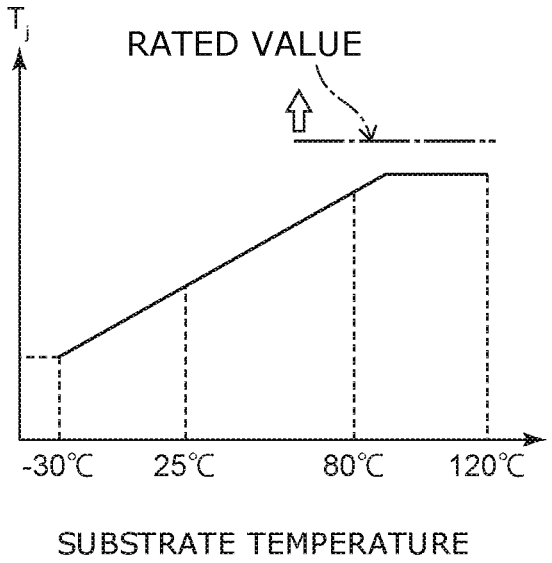

When the combined resistance value R2 rapidly increases, the current $I_F$ flowing through the light-emitting element 22 can be rapidly reduced when the temperature of the light-emitting element 22 becomes too high as shown in FIG. 6C. Therefore, as shown in FIG. 6D, it is possible to suppress the junction temperature $T_j$ of the light-emitting element 22 from exceeding the rated value.

That is, when the positive characteristic thermistor 26 is provided, it is possible to suppress the temperature of the light-emitting element 22 from becoming too high. Therefore, it is possible to suppress the light-emitting element 22 from being broken or to suppress the life from being shortened.

FIGS. 7A to 7D are graphs showing the operation of the resistor 26*a*.

Figure 7A:
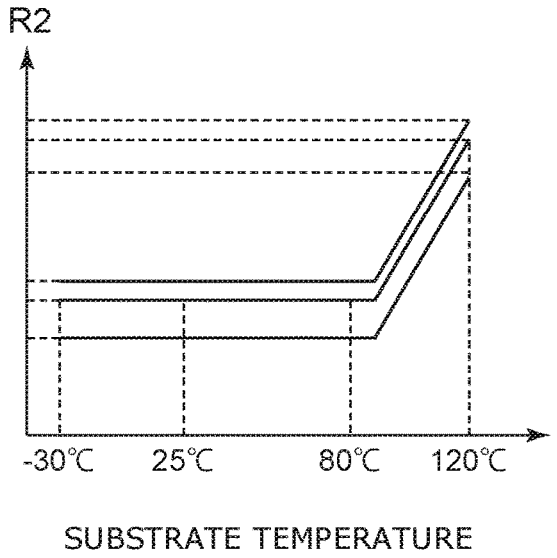
FIGS. 7A to 7D are graphs showing the operation of a resistor.

The resistance value of the positive characteristic thermistor 26 has a variation of about ±20%. Therefore, when the resistance value of the resistor 26*a* is constant, the combined resistance value R2 of the positive characteristic thermistor 26 and the resistor 26*a* also varies as shown in FIG. 7A. When the combined resistance value R2 varies, the total luminous flux of the light emitted from the light-emitting element 22 varies. Further, there is a risk that the junction temperature $T_j$ of the light-emitting element 22 may exceed the rated value.

Figure 7B:
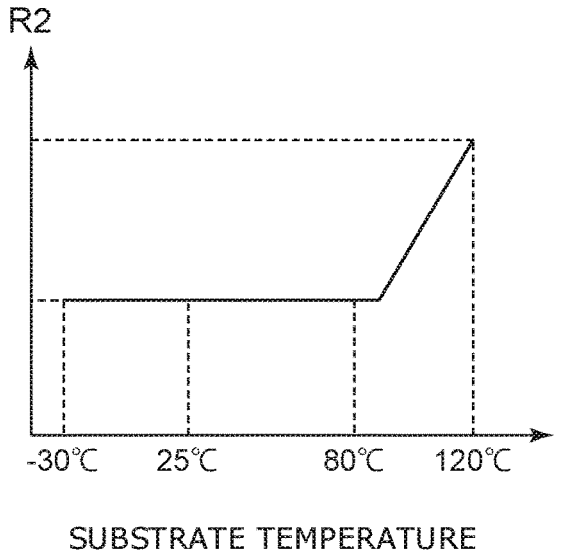

Here, as shown in FIG. 7B, the resistance value of the resistor 26*a* can be changed in response to the resistance value of the positive characteristic thermistor 26 so that the combined resistance value R2 falls within a predetermined range.

Figure 7C:
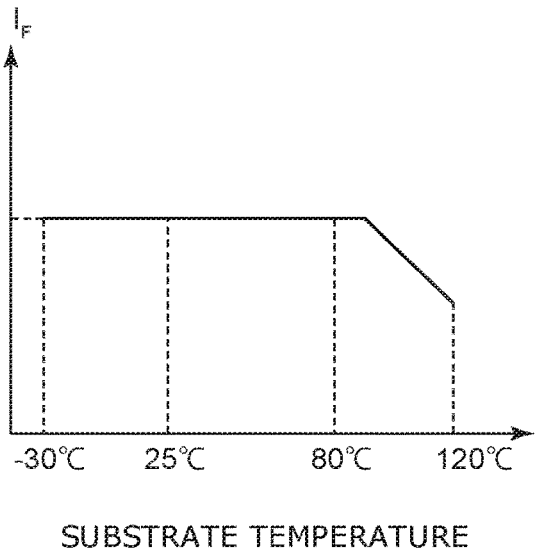
Figure 7D:
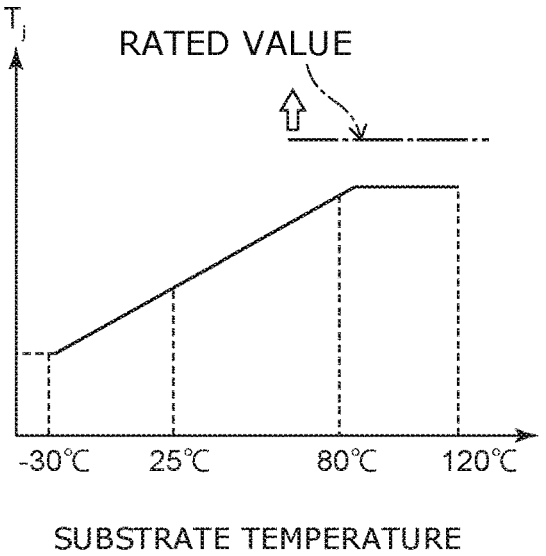

When the combined resistance value R2 is within a predetermined range, a variation in the current $I_F$ flowing through the light-emitting element 22 can be suppressed as shown in FIG. 7C. As a result, a variation in the total luminous flux of the light emitted from the light-emitting element 22 can be suppressed. Further, as shown in FIG. 7D, the junction temperature $T_j$ of the light-emitting element 22 can be suppressed from exceeding the rated value.

The resistor 26*a* can be, for example, a variable resistor. Further, the resistance value can be increased by configuring the resistor 26*a* as a film-shaped resistor and cutting off a part of the film-shaped resistor. The film-shaped resistor can include, for example, ruthenium oxide or the like. A part of the resistor can be cut off by irradiating the film-shaped resistor with laser. That is, the resistor 26*a* can have a film shape and include a slit 26*a*1.

Further, a resistor having an appropriate resistance value may be selected in response to the resistance value of the positive characteristic thermistor 26. In this case, the resistor can be a surface mount type resistor or a resistor having a lead wire.

That is, the resistor 26*a* may be connected in parallel to the positive characteristic thermistor 26 and change the resistance value in response to a variation in the resistance value of the positive characteristic thermistor 26 at a normal temperature (for example, 25° C.).

As described above, in the vehicle luminaire 1 according to the embodiment, the light-emitting element 22 can be protected and a variation in the total luminous flux in accordance with a change in temperature can be suppressed.

Figure 8:
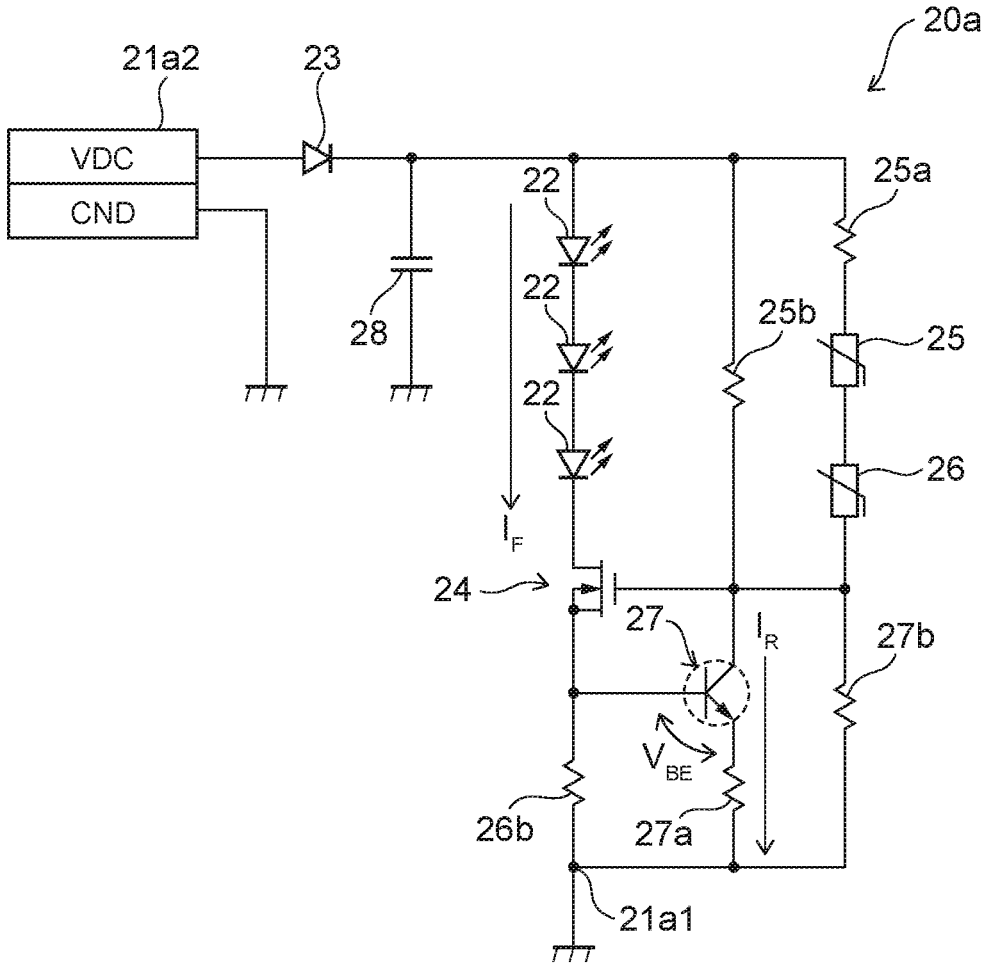
FIG. 8 is a circuit diagram illustrating a light-emitting module provided in a vehicle luminaire according to another embodiment.

FIG. 8 is a circuit diagram illustrating a light-emitting module 20*a* provided in a vehicle luminaire 1*a* according to another embodiment.

FIGS. 9A to 9D are graphs showing the operations and effects of the positive characteristic thermistor 26 and the negative characteristic thermistor 25 connected in series to each other.

Similarly to the above-described light-emitting module 20, the light-emitting module 20*a* can include the substrate 21, the light-emitting element 22, the diode 23, the first transistor 24, the negative characteristic thermistor 25, the positive characteristic thermistor 26, the second transistor 27, the frame portion 29*a*, and the sealing portion 29*b*. Further, the light-emitting module 20 can further include a resistor 25*a*, a resistor 25*b*, a resistor 26*b*, a resistor 27*a*, a resistor 27*b*, and a capacitor 28. These elements can be electrically connected to the wiring pattern 21*a* provided in the substrate 21.

In the above-described light-emitting module 20, the positive characteristic thermistor 26 is connected in parallel to the resistor 26*a*. In the light-emitting module 20*a* according to the embodiment, as shown in FIG. 8, the positive characteristic thermistor 26 is connected in series to the negative characteristic thermistor 25. In this case, the negative characteristic thermistor 25 may be electrically connected to the input terminal 21*a*2 and the positive characteristic thermistor 26 may be electrically connected to the input terminal 21*a*2.

In the light-emitting module 20*a*, the collector of the second transistor 27 is electrically connected to the gate of the first transistor 24 and the negative characteristic thermistor 25 or the positive characteristic thermistor 26. The base of the second transistor 27 is electrically connected to the drain of the first transistor 24. The emitter of the second transistor 27 is electrically connected to the output terminal 21*a*1.

Figure 9A:
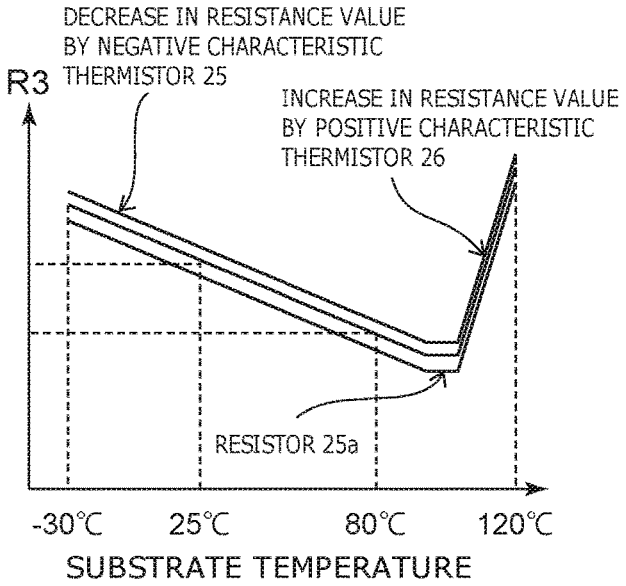
FIGS. 9A to 9D are graphs showing operations and effects of a positive characteristic thermistor and a negative characteristic thermistor connected in series to each other.

As described above, the resistance value of the negative characteristic thermistor 25 gradually decreases in accordance with an increase in the temperature. On the other hand, the resistance value of the positive characteristic thermistor 26 abruptly increases when the temperature exceeds the Curie point. Therefore, as shown in FIG. 9A, the combined resistance value R3 of the negative characteristic thermistor 25, the positive characteristic thermistor 26, and the resistor 25*a* gradually decreases in accordance with a decrease in the resistance value of the negative characteristic thermistor 25 when the temperature of the substrate 21 is relatively low. Additionally, since the light-emitting module 20*a* is also provided with the resistor 25*a*, a decrease in the combined resistance value R3 can also be limited. On the other hand, when the temperature of the positive characteristic thermistor 26 exceeds the Curie point, the combined resistance value R3 rapidly increases in accordance with a rapid increase in the resistance value of the positive characteristic thermistor 26.

Figure 9B:
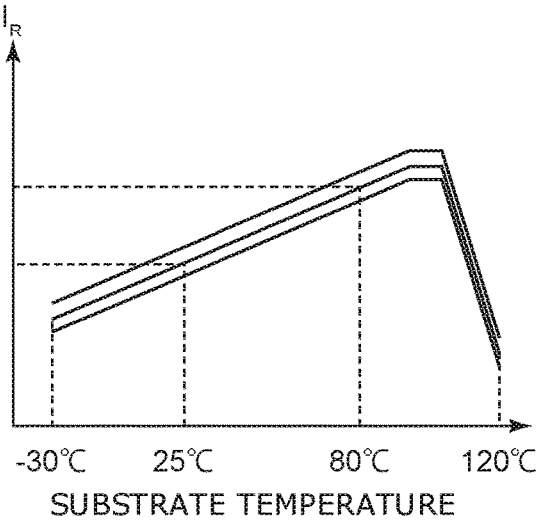

As shown in FIG. 9B, the current $I_R$ flowing through the resistor 27*a* changes in response to a change in the combined resistance value R3. Additionally, since a decrease in the combined resistance value R3 is limited, an increase in the current $I_R$ can also be limited.

Figure 9C:
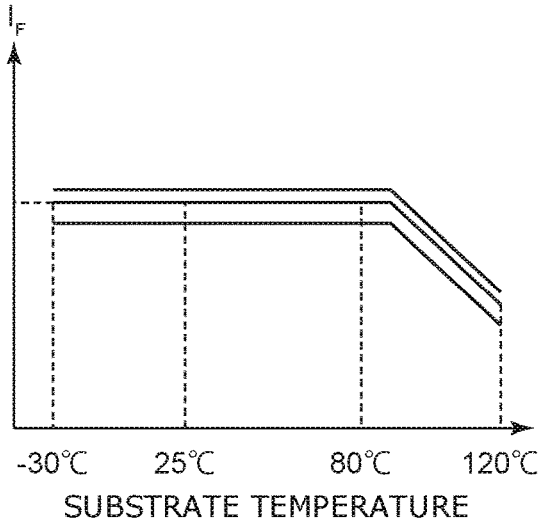

As described above, since a mutual change can be canceled out by adding the voltage $V_{BE}$ across the base and the emitter and the voltage $V_R$ across both ends of the resistor 27*a*, a change in the current $I_F$ flowing through the light-emitting element 22 can be reduced as shown in FIG. 9C when the temperature of the substrate 21 is relatively low.

Figure 9D:
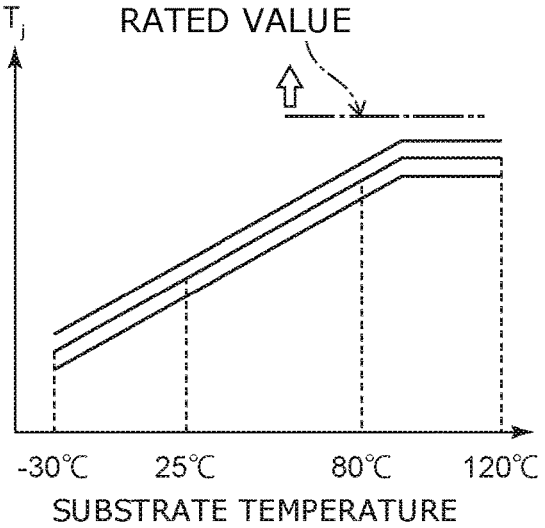

On the other hand, when the temperature of the substrate 21 becomes high so that the temperature of the positive characteristic thermistor 26 exceeds the Curie point, the current $I_F$ flowing through the light-emitting element 22 can be rapidly reduced as shown in FIG. 9C. Therefore, it is possible to suppress the junction temperature $T_j$ of the light-emitting element 22 from exceeding the rated value as shown in FIG. 9D.

Here, the resistance value of the resistor 25*a* can be, for example, about 2.2 kΩ. The resistance value of the resistor 25*a* is substantially constant even when the temperature rises.

When the temperature of the substrate 21 is relatively low, the resistance value of the negative characteristic thermistor 25 becomes much larger than the resistance value of the positive characteristic thermistor 26. For example, when the temperature is about 80° C., the resistance value of the negative characteristic thermistor 25 is about 10 kΩ and the resistance value of the positive characteristic thermistor 26 is about 470Ω. Since the resistance value of the resistor 25*a* and the resistance value of the negative characteristic thermistor 25 are larger than the resistance value of the positive characteristic thermistor 26, a variation in the combined resistance value R3 is extremely small even when the resistance value of the positive characteristic thermistor 26 varies. For example, even when a variation in the resistance value of the positive characteristic thermistor 26 is about ±50%, a variation in the combined resistance value R3 can be about ±2%.

In contrast, when the temperature of the substrate 21 is high, the resistance value of the positive characteristic thermistor 26 is much larger than the resistance value of the negative characteristic thermistor 25. When the resistance value of the positive characteristic thermistor 26 varies, the combined resistance value R3 also varies largely. However, since the resistance value of the resistor 25*a* is large, the influence can be reduced. Further, when the temperature of the substrate 21 is high, it is preferable that the current $I_F$ flowing through the light-emitting element 22 be rapidly reduced in order to protect the light-emitting element 22. Therefore, since the combined resistance value R3 varies, there is no problem even when a variation in the current $I_F$ and further a variation in the total luminous flux become large.

In the light-emitting module 20*a* according to the embodiment, the light-emitting element 22 can be protected and a variation in the total luminous flux in accordance with a change in the temperature can be suppressed. Further, the above-described resistor 26*a* can be also omitted.

Figure 10:
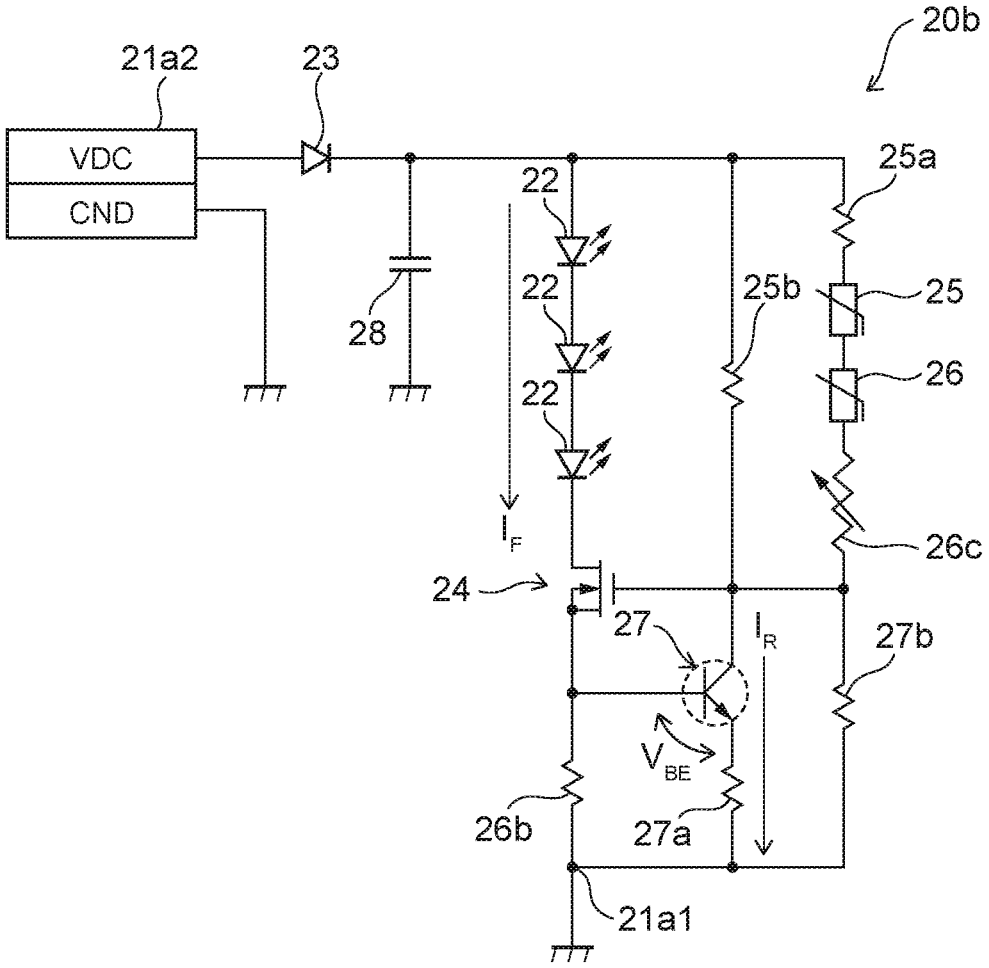
FIG. 10 is a circuit diagram illustrating a light-emitting module according to another embodiment.

FIG. 10 is a circuit diagram illustrating a light-emitting module 20*b* provided in a vehicle luminaire 1*b* according to another embodiment.

FIGS. 11A to 11D are graphs showing the operation and effect of a resistor 26*c* (corresponding to an example of a first resistor) connected in series to the positive characteristic thermistor 26.

As shown in FIG. 10, the light-emitting module 20*b* is a case in which the resistor 26*c* is further provided in the light-emitting module 20*a*. The resistor 26*c* can be connected in series to the positive characteristic thermistor 26. As described above, when the positive characteristic thermistor 26 and the negative characteristic thermistor 25 are connected in series to each other, an influence due to a variation in the resistance value of the positive characteristic thermistor 26 can be reduced. However, when a variation in the resistance value of the positive characteristic thermistor 26 is about ±50%, the combined resistance value R3, the current $I_R$ flowing through the resistor 27*a*, and the junction temperature $T_j$ of the light-emitting element 22 may vary, for example, by about 2% as shown in FIGS. 9A to 9D.

Figure 11A:
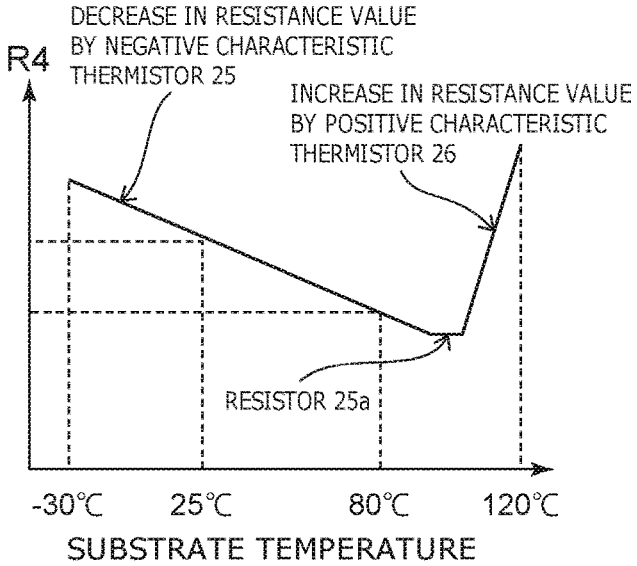
FIGS. 11A to 11D are graphs showing operations and effects of a resistor connected in series to a positive characteristic thermistor.
Figure 11B:
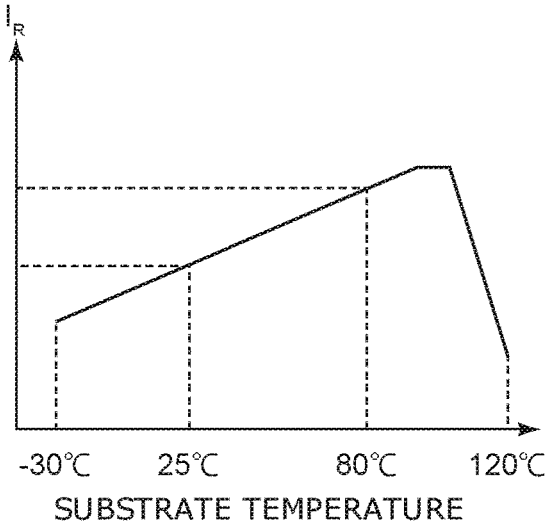
Figure 11C:
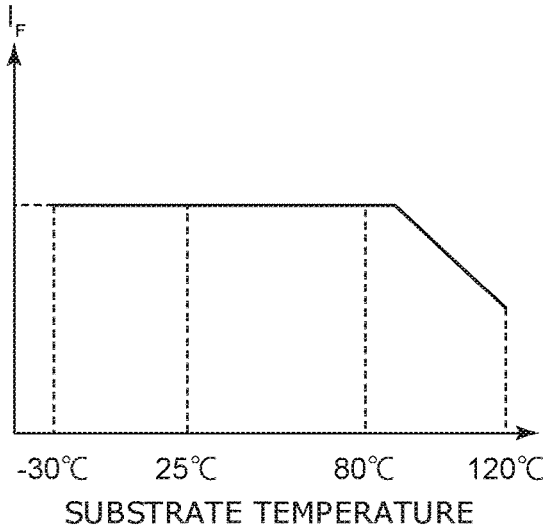
Figure 11D:
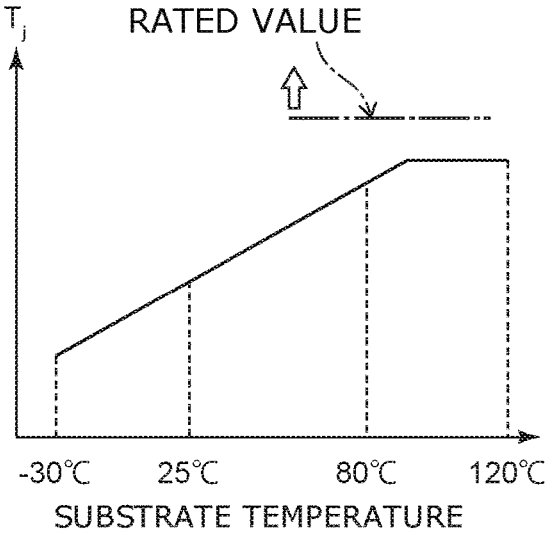

In this case, when the resistor 26*c* is connected in series to the positive characteristic thermistor 26 and the resistance value of the resistor 26*c* is changed in response to the resistance value of the positive characteristic thermistor 26, the combined resistance value can be within a predetermined range. As a result, as shown in FIG. 11A, a variation in the combined resistance value R4 of the negative characteristic thermistor 25, the positive characteristic thermistor 26, the resistor 25*a*, and the resistor 26*c* can be reduced. As shown in FIG. 11B, a variation in the current $I_R$ flowing through the resistor 27*a* can be reduced. As shown in FIG. 11C, a variation in the current $I_F$ flowing through the light-emitting element 22 can be reduced. As shown in FIG. 11D, a variation in the junction temperature $T_j$ of the light-emitting element 22 can be reduced.

The resistor 26*c* can be connected in series to the positive characteristic thermistor 26 and the resistance value can be changed in response to a variation in the resistance value of the positive characteristic thermistor 26 at a normal temperature (for example, 25° C.). The resistor 26*c* can be similar to, for example, the above-described resistor 26*a*.

Similarly to the above-described resistor 26*a*, the resistor 26*c* can have a film shape and have a slit. Further, the resistor 26*c* can include ruthenium oxide similarly to the above-described resistor 26*a*.

As described above, the positive characteristic thermistor 26 can be electrically connected to the gate of the first transistor 24 or the drain of the first transistor 24.

In the second transistor 27, the collector can be electrically connected to the gate of the first transistor 24, the base can be electrically connected to the drain of the first transistor 24, and the emitter can be electrically connected to the output terminal.

Then, when the positive characteristic thermistor 26 is electrically connected to the gate of the first transistor 24, the positive characteristic thermistor 26 and the negative characteristic thermistor 25 may be connected in series to each other as shown in FIG. 8.

Further, when the positive characteristic thermistor 26 is electrically connected to the drain of the first transistor 24, the base of the second transistor 27 can be electrically connected to the drain of the first transistor 24 and the positive characteristic thermistor 26 as shown in FIG. 2.

(Vehicle Lamp)

Next, the vehicle lamp 100 will be illustrated.

Hereinafter, a case in which the vehicle lamp 100 is a front combination light provided in an automobile will be described as an example. However, the vehicle lamp 100 is not limited to a front combination light provided in an automobile. The vehicle lamp 100 may be a vehicle lamp provided in an automobile or a rail car.

Figure 12:
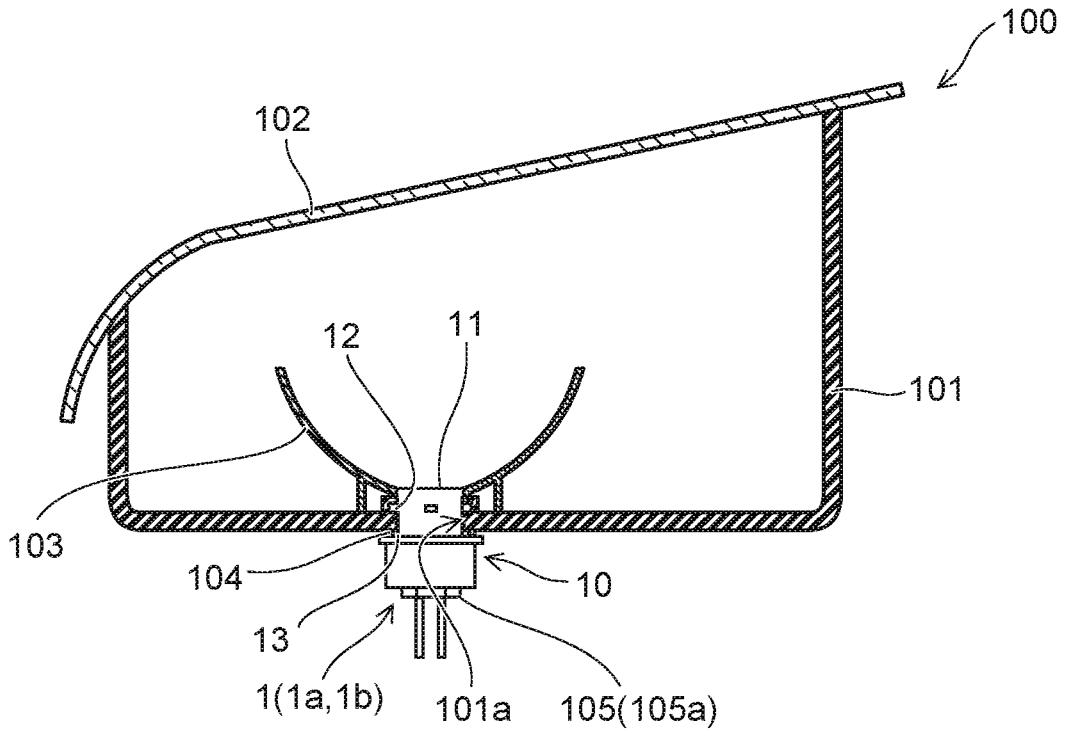
FIG. 12 is a schematic partially cross-sectional view illustrating a vehicle lamp.

FIG. 12 is a schematic partially cross-sectional view illustrating the vehicle lamp 100.

As shown in FIG. 12, the vehicle lamp 100 can be provided with the vehicle luminaire 1 (1*a*, 1*b*), the housing 101, a cover 102, an optical element 103, a seal member 104, and the connector 105.

The vehicle luminaire 1 (1*a*, 1*b*) can be attached to the housing 101. The housing 101 can hold the mounting portion 11. The housing 101 can have a box shape whose one end side is opened. The housing 101 can be formed of, for example, a resin or the like through which light is not transmitted. A bottom surface of the housing 101 can be provided with an attachment hole 101*a* into which a portion provided with the bayonet 12 in the mounting portion 11 is inserted. A circumferential edge of the attachment hole 101*a* can be provided with a concave portion into which the bayonet 12 provided in the mounting portion 11 is inserted. Additionally, a case in which the attachment hole 101*a* is directly provided in the housing 101 has been illustrated, but an attachment member having the attachment hole 101*a* may be provided in the housing 101.

When attaching the vehicle luminaire 1 (1*a*, 1*b*) to the vehicle lamp 100, a portion provided with the bayonet 12 in the mounting portion 11 is inserted into the attachment hole 101*a* and the vehicle luminaire 1 (1*a*, 1*b*) is rotated. Then, the bayonet 12 is held by the concave portion provided in the circumferential edge of the attachment hole 101*a*. Such an attachment method is called a twist lock.

The cover 102 can be provided to block the opening of the housing 101. The cover 102 can be formed of a resin having translucency. The cover 102 can have a function of a lens or the like.

Light emitted from the vehicle luminaire 1 (1*a*, 1*b*) is incident to the optical element 103. The optical element 103 can perform reflection, diffusion, light guiding, light collection, formation of a predetermined light distribution pattern, and the like of the light emitted from the vehicle luminaire 1 (1*a*, 1*b*). For example, the optical element 103 illustrated in FIG. 12 is a reflector. In this case, the optical element 103 can form a predetermined light distribution pattern by reflecting the light emitted from the vehicle luminaire 1 (1*a*, 1*b*).

The seal member 104 can be provided between the flange 13 and the housing 101. The seal member 104 can have an annular shape. The seal member 104 can be formed of an elastic material such as rubber or silicone resin.

When the vehicle luminaire 1 (1*a*, 1*b*) is attached to the vehicle lamp 100, the seal member 104 is sandwiched between the flange 13 and the housing 101. Therefore, the internal space of the housing 101 can be sealed by the seal member 104. Further, the bayonet 12 is pressed against the housing 101 by the elastic force of the seal member 104. Therefore, the separation of the vehicle luminaire 1 (1*a*, 1*b*) from the housing 101 can be suppressed.

The connector 105 can be fitted to the ends of the plurality of power-supply terminals 31 exposed inside the hole 10*b*. A power-supply (not shown) or the like can be eclectically connected to the connector 105. Therefore, a power-supply (not shown) or the like can be electrically connected to the light-emitting element 22 by fitting the connector 105 to the ends of the plurality of power-supply terminals 31.

Further, the connector 105 can be provided with the seal member 105*a*. When the connector 105 having the seal member 105*a* is inserted into the hole 10*b*, the hole 10*b* is sealed so as to be watertight. The seal member 105*a* has an annular shape and can be formed of an elastic material such as rubber or silicone resin.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle luminaire comprising:

a socket; and a light-emitting module which is provided at one end side of the socket, the light-emitting module including:

at least one light-emitting element;

a first transistor of which a source is electrically connected to a cathode of the light-emitting element;

a negative characteristic thermistor which is electrically connected to a gate of the first transistor;

a positive characteristic thermistor which is electrically connected to the gate of the first transistor or a drain of the first transistor; and a second transistor of which a collector is electrically connected to the gate of the first transistor, a base is electrically connected to the drain of the first transistor, and an emitter is electrically connected to an output terminal.

2. The luminaire according to claim 1, wherein when the positive characteristic thermistor is electrically connected to the gate of the first transistor, the positive characteristic thermistor and the negative characteristic thermistor are connected in series to each other.

3. The luminaire according to claim 2, further comprising:

a first resistor which is connected in series to the positive characteristic thermistor and is able to change a resistance value in response to a variation in a resistance value of the positive characteristic thermistor at a normal temperature.

4. The luminaire according to claim 3,
wherein the first resistor has a film shape and includes a slit.

5. The luminaire according to claim 3,
wherein the first resistor includes ruthenium oxide.

6. The luminaire according to claim 1,
wherein when the positive characteristic thermistor is electrically connected to the drain of the first transistor, the base of the second transistor is electrically connected to the drain of the first transistor and the positive characteristic thermistor.

7. The luminaire according to claim 6, further comprising:
a second resistor which is connected in parallel to the positive characteristic thermistor and is able to change a resistance value in response to a variation in a resistance value of the positive characteristic thermistor at a normal temperature.

8. The luminaire according to claim 7,
wherein the second resistor has a film shape and includes a slit.

9. The luminaire according to claim 7,
wherein the second resistor includes ruthenium oxide.

10. The luminaire according to claim 1,
wherein the first transistor is a field effect transistor.

11. The luminaire according to claim 1,
wherein the second transistor is a bipolar transistor.

12. The luminaire according to claim 1, further comprising:
a third resistor which is electrically connected across the emitter of the second transistor and the output terminal.

13. The luminaire according to claim 1,
wherein a plurality of the light-emitting elements are provided and the plurality of light-emitting elements are connected in series to each other.

14. The luminaire according to claim 1,
wherein the light-emitting module further includes a substrate and the light-emitting element, the negative characteristic thermistor, and the positive characteristic thermistor are provided on one surface of the substrate.

15. The luminaire according to claim 14,
wherein the positive characteristic thermistor is thermally connected to the light-emitting element through the substrate.

16. The luminaire according to claim 14,
wherein the negative characteristic thermistor is provided adjacent to the positive characteristic thermistor.

17. The luminaire according to claim 14,
wherein the substrate includes ceramics.

18. The luminaire according to claim 14, further comprising:
a heat transfer portion which is provided between the substrate and the socket and includes metal.

19. The luminaire according to claim 1,
wherein the socket includes a high thermal conductive resin.

20. A vehicle lamp comprising:
the vehicle luminaire according to claim 1; and
a housing to which the vehicle luminaire is attached.

* * * * *